US005599180A

United States Patent [19]

Peters et al.

[11] Patent Number: 5,599,180

[45] Date of Patent: Feb. 4, 1997

[54] CIRCUIT ARRANGEMENT FOR FLAME DETECTION

[75] Inventors: Odd Peters, Bietingheim-Bissingen; Dieter Teutsch, Sachsenheim, both of Germany

[73] Assignee: Beru Ruprecht GmbH & Co. KG, Germany

[21] Appl. No.: 279,647

[22] Filed: Jul. 25, 1994

[30] Foreign Application Priority Data

Jul. 23, 1993 [DE] Germany ..... 43 24 863.2

[51] Int. Cl.[6] ..... F23N 5/12

[52] U.S. Cl. ..... 431/13; 431/24; 431/25; 431/78

[58] Field of Search ..... 431/24, 25, 13, 431/75, 26, 18, 78

[56] References Cited

U.S. PATENT DOCUMENTS

| | | | |
|---|---|---|---|
| 4,167,767 | 9/1979 | Courier de Méré . | |
| 4,324,542 | 4/1982 | Challet | 431/25 X |
| 4,519,771 | 5/1985 | Six et al. | 431/25 |
| 4,521,180 | 6/1985 | Walter et al. | 431/25 |
| 4,552,528 | 11/1985 | Gaiffer | 431/25 |
| 4,557,236 | 12/1985 | Showalter . | |
| 4,871,307 | 10/1989 | Harris et al. | 431/25 |
| 5,178,120 | 1/1993 | Howson et al. | 123/605 |

FOREIGN PATENT DOCUMENTS

| | | | |
|---|---|---|---|
| 9220912 | 11/1992 | France . | |
| 2731082 | 7/1977 | Germany . | |
| 3706555 | 1/1988 | Germany . | |
| 4130013 | 4/1992 | Germany . | |
| 4107335 | 9/1992 | Germany . | |
| WO8101605 | 6/1981 | WIPO | 431/25 |

*Primary Examiner*—Carl D. Price

*Attorney, Agent, or Firm*—Sixbey, Friedman, Leedom & Ferguson, P.C.; David S. Safran

[57] ABSTRACT

A circuit arrangement for flame detection for a transistor coil ignition system of a burner is disclosed. The transistor coil ignition system features a trigger stage which triggers a power transistor that is located in the power circuit of the primary winding of an ignition coil in order to charge the primary winding of the ignition coil with a charging current from a power supply. A circuit arrangement includes a switch having an ignition position and a flame detection position which in the flame detection position restricts the charging current flowing via the primary winding of the ignition coil to an intensity that lies below the charging current intensity needed to generate an ignition spark in the ignition position, so that ignition spark-over cannot take place without a flame. An analysis circuit analyzes the signal from the primary winding of the ignition coil that is generated after the charging current flowing via the primary winding of the ignition coil, in which case said signal has pulse peaks when there is no flame and has no such pulse peaks when the flame is present. The analysis is preferably performed on a display signal that is present at a display device in order to indicate the presence or absence of a flame in the burner.

16 Claims, 5 Drawing Sheets

CIRCUIT ARRANGEMENT FOR FLAME DETECTION

BACKGROUND OF THE INVENTION

1. Field of the Invention

The present invention pertains to a circuit arrangement for flame detection for a transistor coil ignition system of a burner, which features a trigger stage that triggers a power transistor which is located in the power circuit of the primary winding of an ignition coil.

2. Description of Related Art

A transistor coil ignition system, whose structure and operation are known per se, is provided as an ignition device in burners that operate on gas, diesel fuel, gasoline, or other fuels. The desire in this regard is to monitor the burner flame, i.e., to provide for flame detection and ignition diagnosis.

German Published Application 37 06 555 discloses one way of providing an ionization electrode for flame monitoring of an ignition device in the form of a glow plug with a glow-plug body that is integrated into the glow plug. In the case of this known type of flame monitoring, additional circuitry is needed for triggering, whereby ignition diagnosis is still difficult and signal analysis proves to be prone to error. From the standpoint of fabrication engineering, additional design expenses also result.

German Published Application 41 07 335 discloses a process and a device for ignition monitoring of an ignition system. This process and device can be used to check the ignition system for shunts and breaks on the secondary high-voltage side. In addition, ignition diagnosis is performed in the ignition phase.

SUMMARY OF THE INVENTION

It is an object of the present invention to provide a circuit design that allows for reliable detection of a flame in a burner having a transistor coil ignition system with a low circuit cost.

This object is achieved by the invention with a circuit which features a trigger stage that triggers a power transistor which is located in the power circuit of the primary winding of an ignition coil.

Using this design, it is possible to design the circuit arrangement of the invention, the entire transistor coil ignition system in which said arrangement is provided, simply and compactly in the form of a complete device.

Furthermore, one improved version of the present invention makes possible supplemental diagnosis for the purpose of detecting shunts and breaks, as well as short-circuiting of the ignition system in the ignition phase, and to do so in addition to flame detection in the flame detection phase.

Particularly preferred embodiments of the invention are described in greater detail below with reference to the corresponding drawings.

DETAILED DESCRIPTION OF THE PREFERRED EMBODIMENTS

Figure 1:
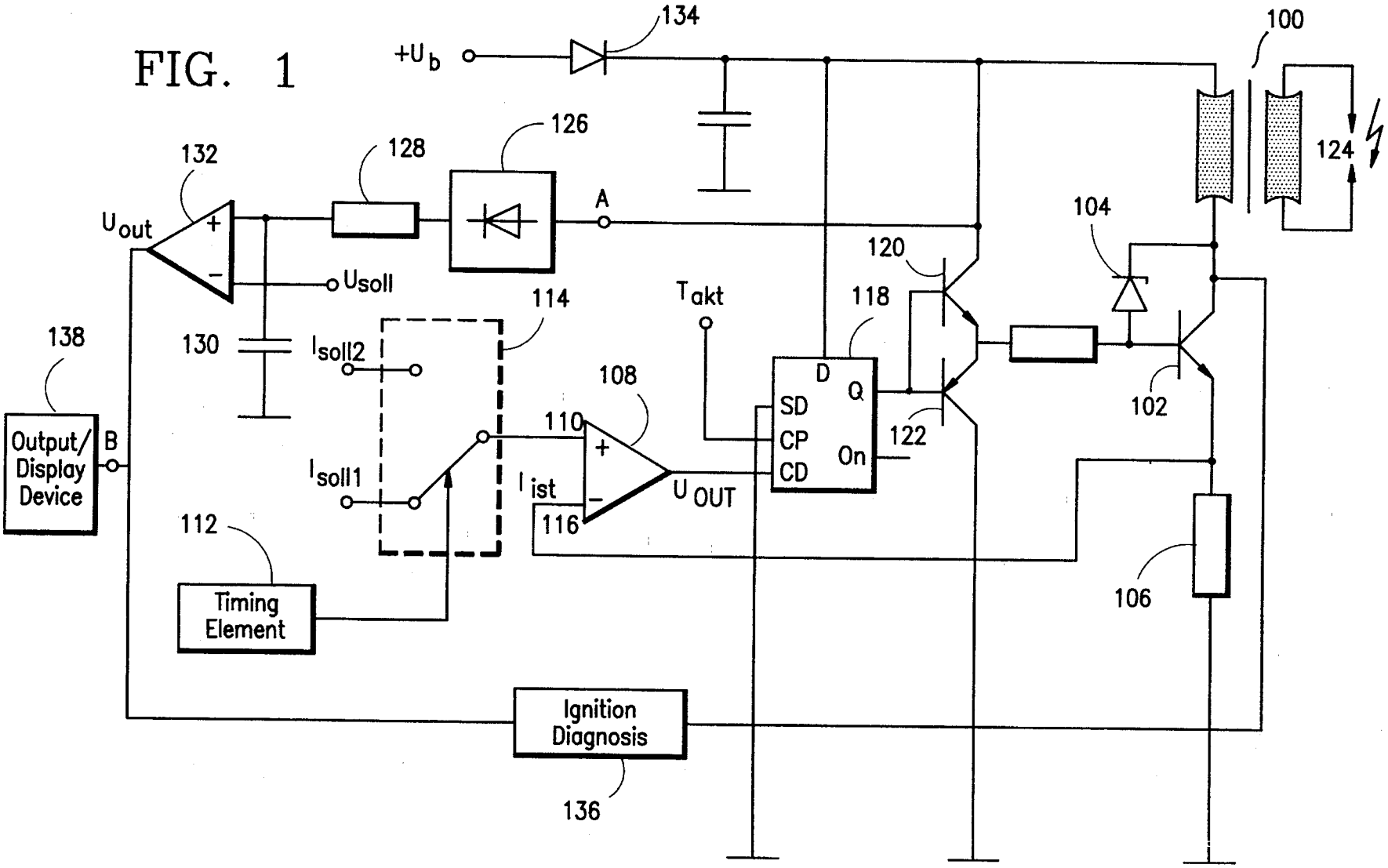
FIG. 1 shows a schematic wiring diagram of an embodiment of the circuit arrangement of the present invention.

FIG. 1 illustrates a block diagram of a conventional transistor coil ignition system which is equipped with an embodiment of the circuit arrangement of the present invention for flame detection.

The transistor coil ignition system consists of an ignition coil 100, a power transistor 102 with a voltage-limiting Zener diode 104, and a current sensor 106 for registering current. In the case of the embodiment depicted in FIG. 1, the trigger stage of the transistor coil ignition system is composed of a comparator 108, at whose positive input 110, one of two nominal current values $I_{soll1}$ and $I_{soll2}$ is present, which ensures triggering during an ignition phase of arbitrary length and during a flame detection phase of arbitrary length respectively. The corresponding lengths of these two phases are determined by a timing element 112, which operates a switch 114 with two contacts for the two nominal current values so that, depending on the switch position, a corresponding nominal current value is present at the input 110 of comparator 108. Based on this design, however, ignition and flame detection are not possible simultaneously.

At the second input 116 to comparator 108 is the actual current value of the current that is flowing in the primary winding of ignition coil 100 with power transistor 102 turned on; said current is registered by current sensor 106, which may be in the form of a resistor.

Comparator 108 triggers a flip-flop 118 with a clock input CP, whose non-inverting output Q is present at a driver stage, which in the present case includes transistors 120 and 122 switched in the push-pull mode. Power transistor 102 is triggered by the driver stage in order to charge the primary winding of ignition coil 100.

The details of the operation and structure of such a transistor coil ignition system are known to one of skill in the art and will therefore not be dealt with here in any further detail.

While in the ignition phase, nominal current value $I_{soll1}$ is present at comparator 108 so that the flow of current in the primary winding of ignition coil 100 is sufficient, when power transistor 102 is turned off, to generate an ignition spark at spark gap 124, i.e., at the electrodes or the glow plug. Nominal current value $I_{soll2}$ is present at comparator 108 in the flame detection phase; this latter value is smaller than nominal current value $I_{soll1}$ and ensures that via the primary winding of ignition coil 100 there is a flow of current that is reduced to such an extent that at the electrodes there can be no spark-over in non-conductive media, e.g. , an air or a gaseous mixture.

If, however, a flame is present at spark gap 124, spark gap 124 will be ionized and thus in a conductive state, so that spark-over will occur since the voltage does not have to perform ionization work at spark gap 124 (i.e. the voltage does not have to first ionize the gas in the spark gap 124).

The amplitude of the pulses that appear on the secondary side of ignition coil 100, i.e., at spark gap 124, should be adjusted as a function of the length of spark gap 124, i.e., the interelectrode distance and/or the flow rate of the gaseous mixture and/or the flame speed. Specifically, at higher speeds, enlargement of the ionization channel takes place; this corresponds to an enlargement of the interelectrode distance compared to the conditions that prevail in the case of a gaseous mixture at rest. This adjustment can be done by appropriately selecting the level of value $I_{soll2}$ at comparator 108; this can be accomplished, for example, with the aid of a generator that delivers a variable voltage, e.g., a ramp generator instead of switch 114 (shown in FIG. 5).

Spark-over is monitored by means of a flame detection device which, as shown in FIG. 1, consists of a rectifier 126, a storage element in the form of an RC element 128, 130 and a comparator 132: after power transistor 102 is turned off, in the flame detection phase this device analyzes the signal from the primary winding of ignition coil 100 to detect whether a flame is present and to generate a flame status signal.

The signal that is then present at the cathode of diode 134 is integrated by RC element 128, 130 and by comparator 132, and compared with a nominal value that is present at a second input of comparator 132. The output of comparator 132 constitutes a flame status signal that represents whether or not a flame is present at spark-gap 124.

In order to achieve error-free detection of the flame as well as reliable determination of the operation of the ignition system, an ignition diagnosis device 136 can be additionally provided, which, in the ignition phase, checks the ignition system for shunts and breaks on the secondary high-voltage side. This kind of ignition diagnosis device is known by those of skill in the art and is therefore not discussed in any further detail.

If an error occurs in the ignition or flame detection phase, this is indicated and announced at an output/display device 138, where the output signals of comparator 132 for flame detection and ignition diagnosis device 136 are present.

Below the operation of the embodiment of the above-described circuit arrangement of the invention is explained in detail, referring to FIGS. 2–4.

When battery voltage $+U_b$ is activated, reference value $I_{soll1}$ is present at comparator 108. This means that the ignition system is in the ignition phase, whose duration is determined by timing element 112. In this ignition phase, in addition to ignition, an ignition diagnosis is performed via ignition diagnosis device 136 at the same time, so that spark gap 124 is checked for breaks and shunts in the electrodes.

Figure 2B:
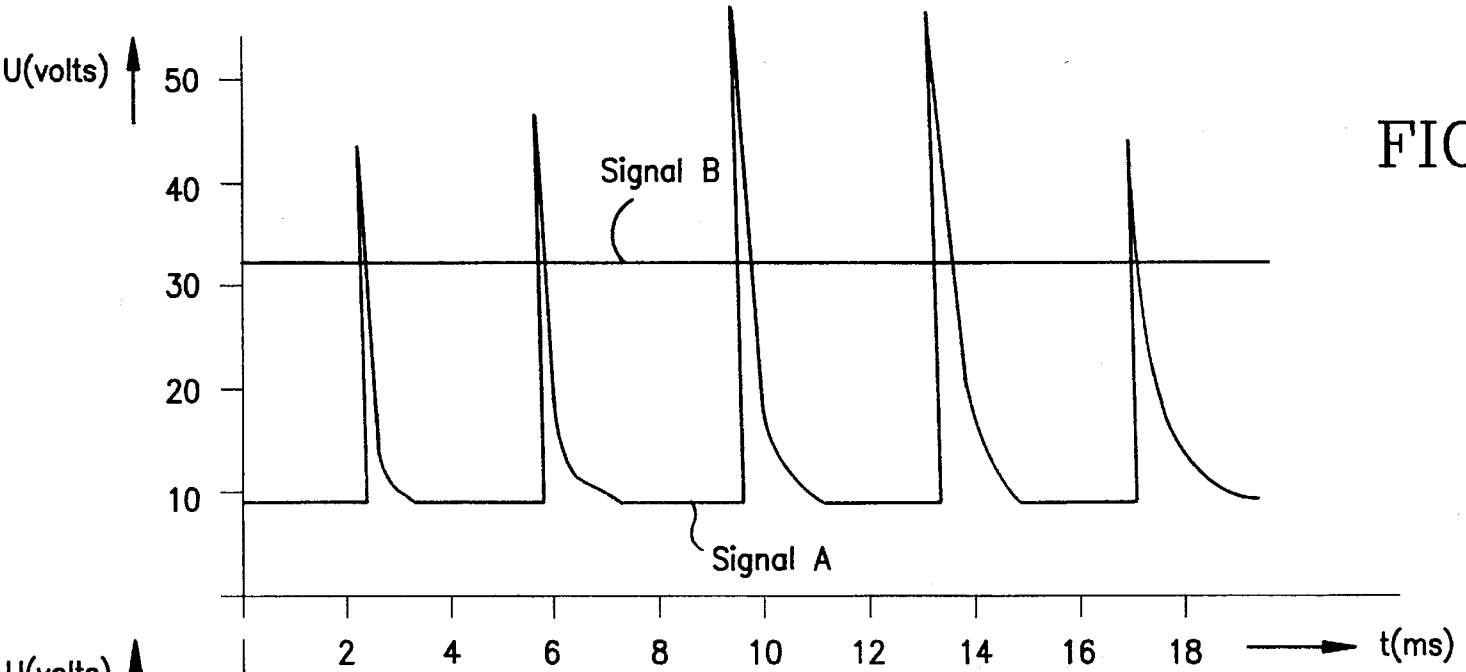
FIGS. 2–4 show in time-dependency diagrams the signal plots of signals that appear at certain points in the circuit arrangement shown in FIG. 1.
Figure 2A:
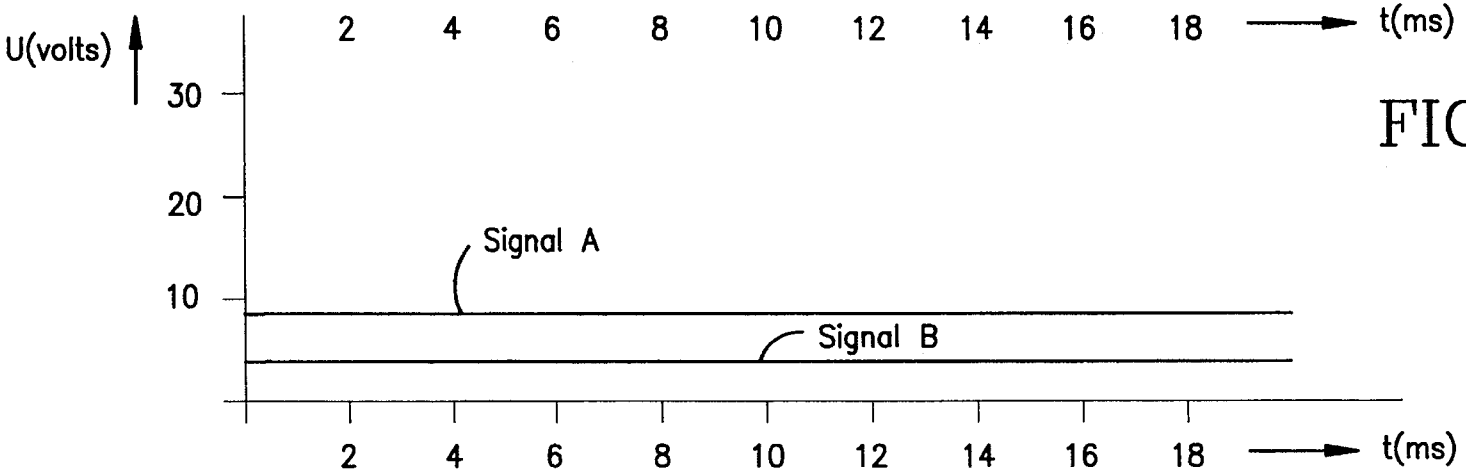

Once the ignition phase ends, timing element 112 switches reference value $I_{soll2}$ to comparator 108 using switch 114. This reduces the primary charging current of ignition coil 100, which is registered by current sensor 106, to such an extent that spark-over cannot occur at spark gap 124 without a flame. Signals with the plots shown in FIGS. 2A and 2B are then present at points A and B, as indicated, in the wiring diagram in FIG. 1. The plot shown in FIG. 2A illustrates the signals at points A and B when a flame exists in spark-gap 124. FIG. 2B illustrates the signals at points A and B in FIG. 1 when no flame exists in spark-gap 124.

Figure 3B:
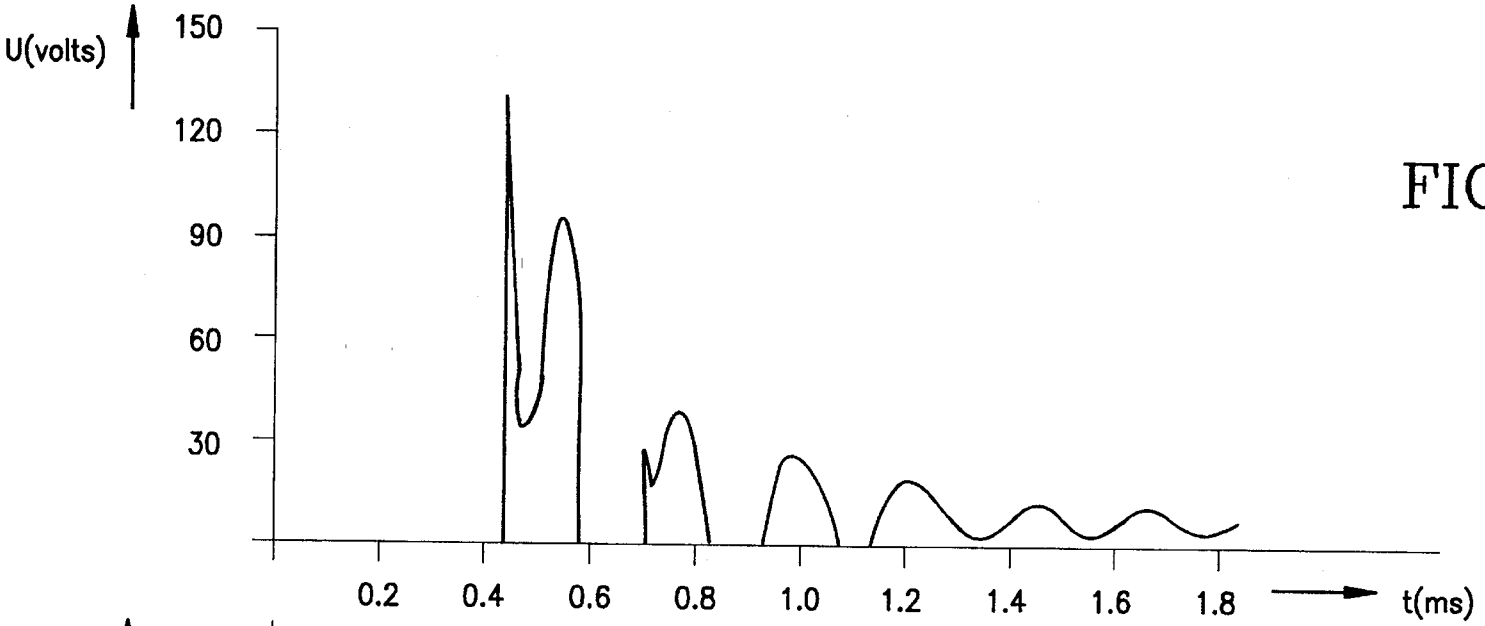
Figure 3A:
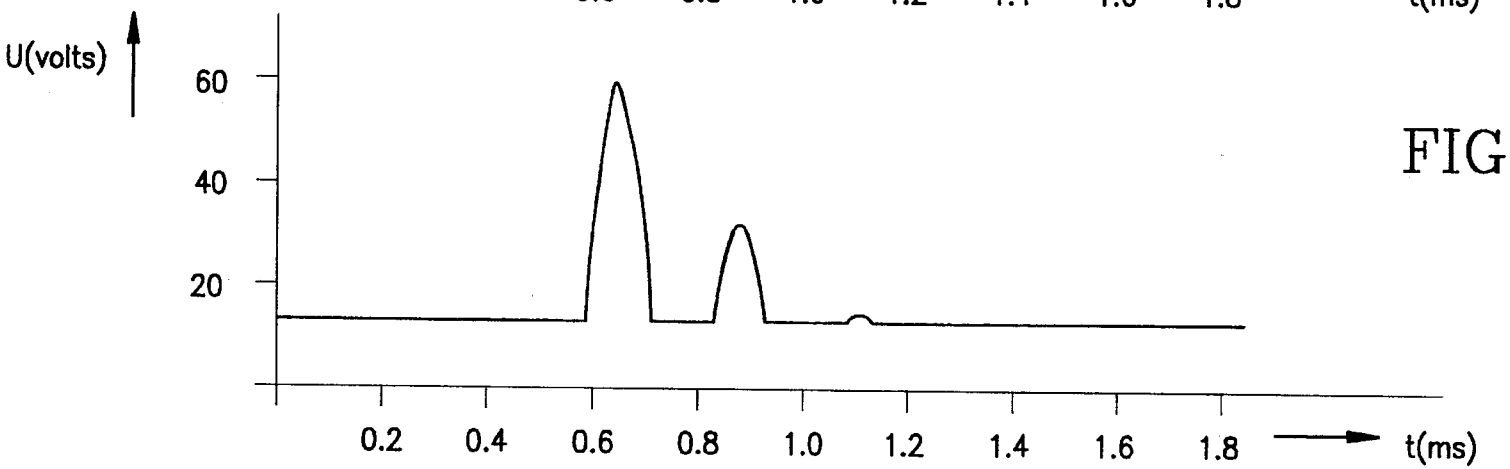

FIGS. 3A and 3B illustrate signal waveforms that are present when no flame exists in spark-gap 124. When current is shut off by blocking of power transistor 102, semioscillations appear at point A, as shown in FIG. 3A. These semioscillations are produced by the negative portions of oscillations conducted to ground by the collector-emitter section diode of transistor 102. FIG. 3B illustrates the voltage $U_{CE}$ on transistor 102 and shows gaps where the negative portions of the oscillations, which correspond to the positive pulses shown in FIG. 3A, would be present. These positive pulses as shown in FIG. 3A are present at the cathode of diode 134.

If the secondary circuit of ignition coil 100 is now charged by spark gap 124 as a result of a spark-over, which occurs only in the flame detection phase when a flame is present, i.e., when the spark gap is ionized by a flame, then a portion of the energy stored in the magnetic circuit of ignition coil 100 is consumed. The effect of this is that the shut-off voltage values at transistor 102 are considerably smaller than without a flame and the collector-emitter section diode of transistor 102 is no longer switched into the conducting state.

In physical terms, the charging of ignition coil 100 that takes place when a flame is present can be attributed to a spark-over at spark gap 124 that results due to the ionization of spark gap 124, such that the energy required for the spark-over is considerably less than that needed in the case of non-ionized and non-conductive media such as air or other gaseous mixtures.

Figures 4A, 4B:
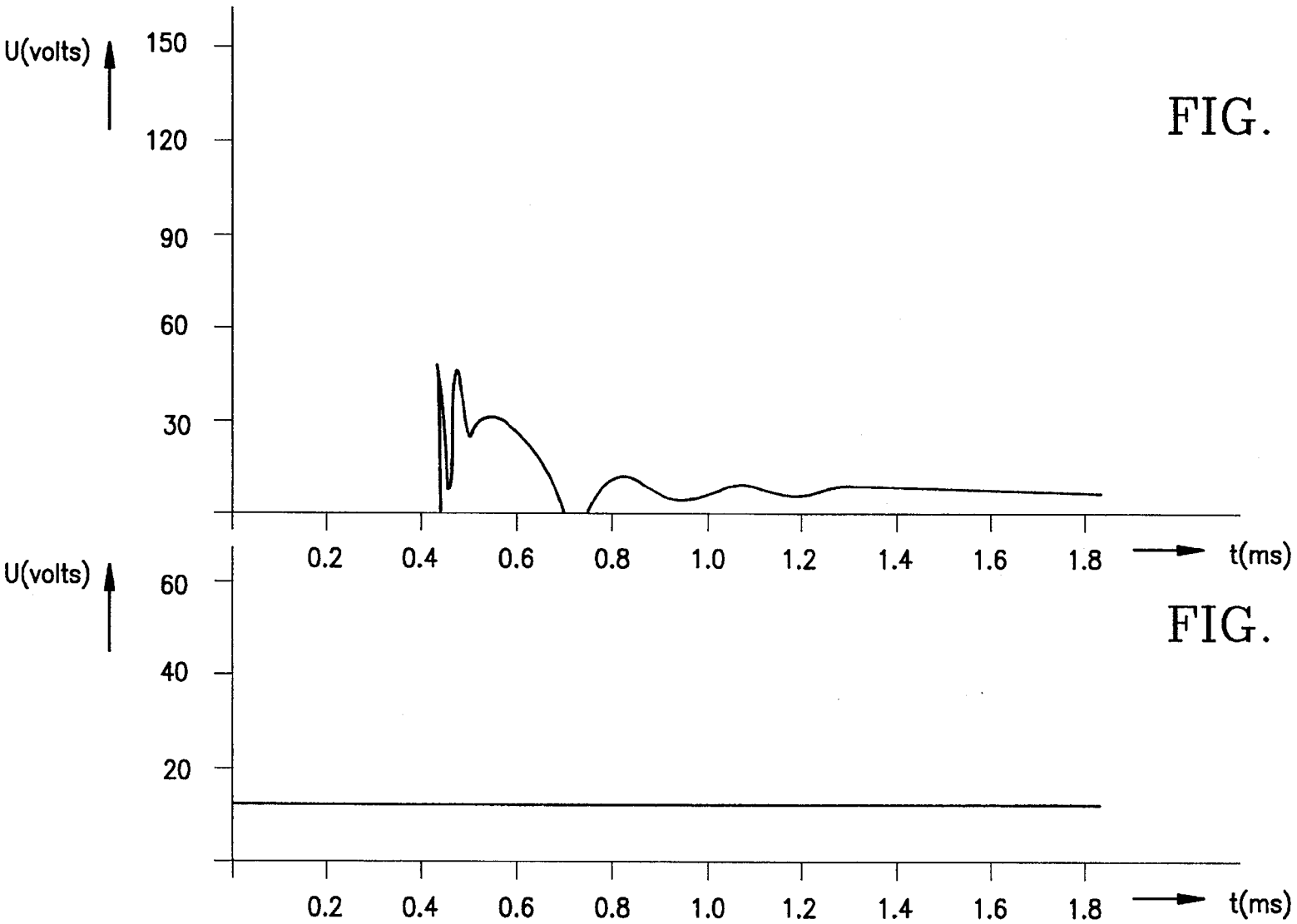

FIGS. 4A and 4B illustrate signal waveforms that are present when a flame exists in spark-gap 124. FIG. 4B illustrates the voltage $U_{CE}$ on transistor 102. Because of the charging of ignition coil 100 when a flame is present and the smaller shut-down voltage values at transistor 102 that this provides, no pulses are present at point A or at diode 134, as shown in FIG. 4A.

The signal that is present at point A with or without pulse peaks (FIG. 3A, FIG. 4A) is rectified by rectifier 126 and smoothed by integration element 128, 130. The smoothed voltage is present at comparator 132, which compares it to a reference voltage $U_{SOLL}$. Depending on the signal state at point A, an output signal. $U_{out}$ is obtained from comparator 132 which leads to an appropriate display at output/display device 138. The error signal that is formed in this case can be used for further processing. Furthermore, output/display device 138 may include associated processing circuitry for processing information prior to the display of that information.

Figure 5:
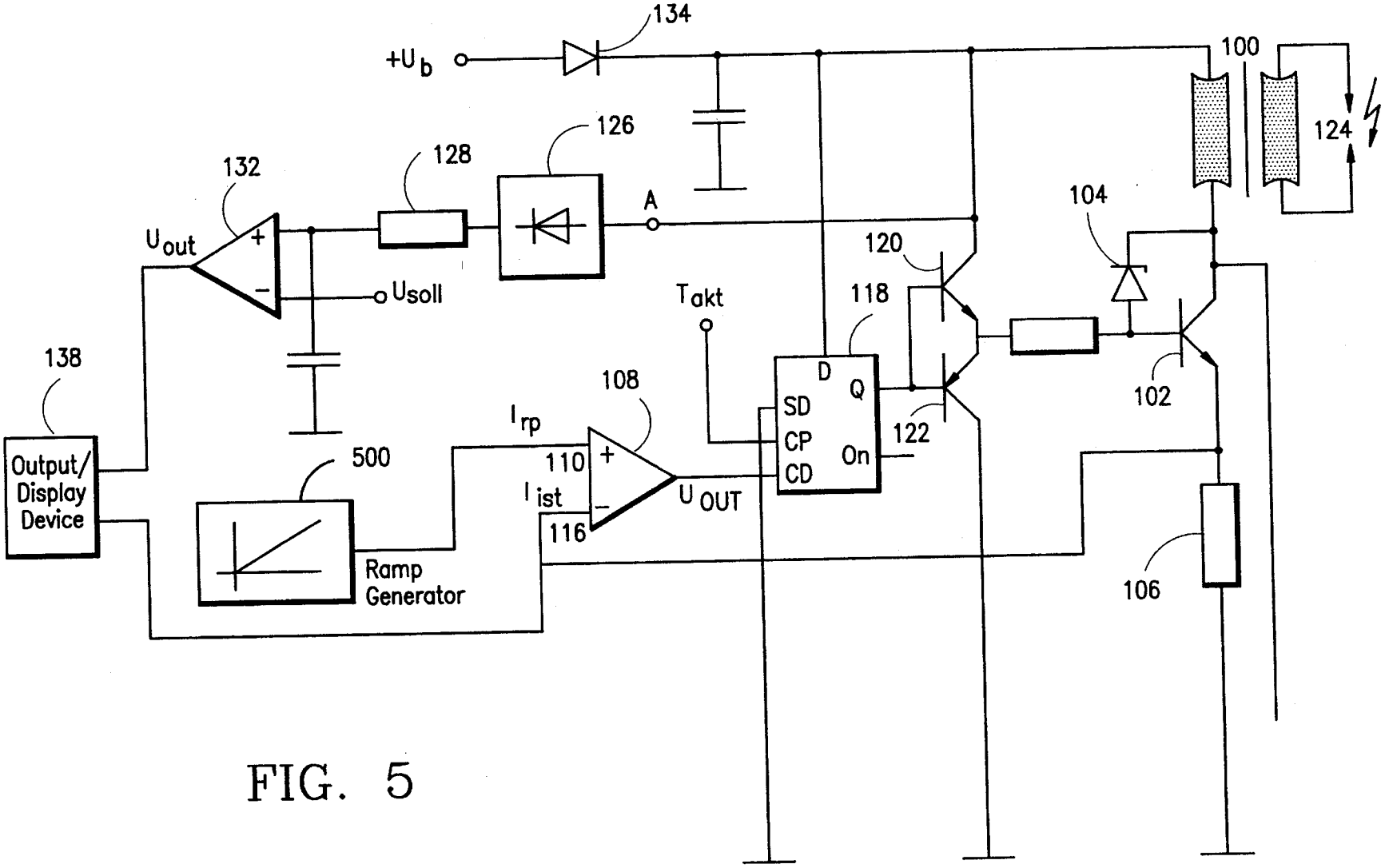
FIG. 5 shows a schematic wiring diagram of another embodiment of the circuit arrangement of the present invention.

FIG. 5 shows the schematic wiring diagram of another embodiment of the circuit arrangement of the invention wherein like reference numerals are used for like components shown in FIG. 1. This embodiment differs from that depicted in FIG. 1 by the circuit arrangement design, which in the flame detection phase restricts the charging current flowing in the primary winding of ignition coil 100 to a current level that lies below the charging current level needed to generate an ignition spark in the ignition phase. While in the case of the embodiment depicted in FIG. 1 this circuit device consisted of a timing element 112 and a switch 114 that was actuated by timing element 112, in the embodiment shown in FIG. 5 this circuit device is formed by a ramp generator 500, whose output voltage is present at comparator 108 in the form of a value $I_{rp}$.

The embodiment of the circuit arrangement of the invention depicted in FIG. 5 is further distinguished from that shown in FIG. 1 by the fact that the value $I_{ist}$, i.e., the actual current value of the current that flows in the primary winding of ignition coil 100 when power transistor 102 is turned on is present not only at the input of comparator 108, but also at an output/display device 138 that may include a signal analysis device.

The embodiment shown in FIG. 5 is particularly suitable for providing information, based on the amplitude of the flame detection pulses, on the flow rate of the flame or the gaseous mixture in the combustion chamber. To do this, pulses with rising voltage amplitude are switched to spark gap 124. This is accomplished by ramp generator 500, whose output signal rises linearly with time. Due to the corresponding continuous increase in primary charging current $I_{ist}$, which flows via current sensor 106, pulses with rising amplitude are then generated on the secondary side of ignition coil 100. Since the ionization channel, i.e., actual spark gap 124 grows larger at higher gaseous-mixture speeds or higher flame speeds, the height of the amplitude of the pulses at spark gap 124 that is needed to bring about a spark-over provides combustion information, including information on the flame speed or speed of the gaseous mixture.

At the instant when a spark-over takes place for the first time as the voltage amplitude of the pulses at spark gap 124 rises, from rectifier 126 the analysis circuit delivers to integration element 128, 130 signal $U_{out}$, which is present at output/display device 138, via comparator 132. The value of primary charging current $I_{ist}$ that occurs at this instant, i.e., at the instant when signal $U_{out}$ appears at comparator 132, is also present at output/display device 138. Output/display device 138 includes a signal processing device in such a way that the input values can be stored and can be analyzed and used as a measure of the speed of the flame or gaseous mixture.

Compared to the embodiment of the circuit arrangement of the invention shown in FIG. 1, that depicted in FIG. 5 thus offers the additional ability not only to perform flame detection, but also to provide information on the speed of the flame or the gaseous mixture to be ignited.

The ways in which an ignition system of this type with ignition diagnosis and flame detection can be used include an intermittent mode of the ignition phase and flame detection, a successive mode of operation, or an externally controlled mode of operation.

If a break on the high-voltage side occurs in the flame detection phase, then this is detected and indicated. This means that in the flame detection phase spark gap 124 is checked for breaks in the high-voltage connections; as in the case of flame detection, this can be done using either a charged or uncharged ignition coil 100.

Because of the low circuitry expense, the above-described circuit arrangement can be fabricated at reasonable cost, but it still offers the possibility of reliable flame detection, as well as additional ignition diagnosis capability for ruling out false alarms.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A flame detection circuit for a burner having a transistor coil ignition system that includes a trigger stage which turns off a power transistor located in a power circuit of a primary winding of an ignition coil upon a predetermined current level in the power circuit of the primary winding being attained, wherein a secondary winding of the ignition coil is connected across a spark gap and the predetermined current level is determined such that the voltage induced in the secondary winding upon turning off the power transistor generates an ignition spark over the spark gap, comprising:

current control means located in the trigger stage for restricting the current level flowing in the power circuit of the primary winding of the ignition coil to a current level such that the voltage induced in the secondary winding of the ignition coil when the power transistor is turned off results in a spark discharge only if a flame exists in the burner, and analysis means for receiving a signal that appears across the primary winding of the ignition coil after the power transistor has been turned off, for analyzing said signal to determine whether a flame exists in the burner, and for transforming said signal into a corresponding output signal.

2. The flame detection circuit of claim 1, further comprising an ignition diagnosis device connected with, and providing an output signal to, a display device.

3. A method for detecting a flame in a burner having a transistor coil ignition system, which includes a trigger stage that triggers a power transistor located in a power circuit of a primary winding of an ignition coil, comprising the steps:

restricting charging current flowing in the primary winding of the ignition coil to a current level below a charging current level needed to generate an ignition spark in an ignition phase;

receiving a first signal from the primary winding, said first signal being produced when said charging current flowing in the primary winding of the ignition coil is interrupted; and processing said first signal to generate a second signal indicating whether a flame exists in the burner, wherein said step of processing said first signal to generate a second signal indicating whether a flame exists in the burner includes the steps of integrating said first signal and comparing said integrated first signal with a predetermined reference signal.

4. A flame detection circuit for a burner having a transistor coil ignition system that includes a trigger stage connected with a primary winding of an ignition coil for triggering a power transistor located in a power circuit of the primary winding of the ignition coil, comprising:

current control means connected to said trigger stage for restricting charging current flowing in the primary winding of the ignition coil to a current level below a charging current level needed to generate an ignition spark in an ignition phase; and analysis means connected with the primary winding of the ignition coil, said analysis means comprising a first means for receiving a first signal from the primary winding, said first signal being produced when said charging current flowing in the primary winding of the ignition coil is interrupted, and a second means for generating a second signal indicating whether a flame exists in the burner, said analysis means further comprising:

a rectifier connected with the primary winding of the ignition coil;

integration means connected with said rectifier for integrating an output signal received from said rectifier; and a second comparator having a first input and a second input, wherein said first input of said second comparator is connected with said integration means, said second input of said second comparator is connected with a predetermined reference value, and said comparator produces a flame status signal that corresponds to a comparison of said signal received from said integration means and said reference value.

5. The flame detection circuit of claim 4, further comprising an ignition diagnosis device connected with, and providing an output signal to, a display device.

6. The flame detection circuit of claim 4, wherein an output of said second comparator is connected with a display device.

7. A flame detection circuit for a burner having a transistor coil ignition system that includes a trigger stage connected with a primary winding of an ignition coil for triggering a power transistor located in a power circuit of the primary winding of the ignition coil, comprising:

current control means connected to said trigger stage for restricting charging current flowing in the primary winding of the ignition coil to a current level below a charging current level needed to generate an ignition spark in an ignition phase, said current control means comprising:

a timing element;

a first comparator having a first input and a second input;

a switch connected with said timing element and said first input of said first comparator, said switch being actuated by said timing element and operating to apply a predetermined current level for one of a flame detection phase and an ignition phase to said first input of said first comparator; and a current sensor connected with the primary winding of the ignition coil and said second input of said first comparator, said current sensor operating to provide the current level in the primary winding of the ignition coil to said second input of said first comparator, and analysis means connected with the primary winding of the ignition coil, said analysis means comprising a first means for receiving a first signal from the primary winding, said first signal being produced when said charging current flowing in the primary winding of the ignition coil is interrupted, and a second means for generating a second signal indicating whether a flame exists in the burner.

8. The flame detection circuit of claim 7, wherein said analysis means comprises:

a rectifier connected with the primary winding of the ignition coil;

integration means connected with said rectifier for integrating an output signal received from said rectifier; and a second comparator having a first input and a second input, wherein said first input of said second comparator is connected with said integration means, said second input of said second comparator is connected with a predetermined reference value, and said comparator produces a flame status signal indicating whether a flame exists in the burner that corresponds to a comparison of said signal received from said integration means and said reference value.

9. The flame detection circuit of claim 8, further comprising an ignition diagnosis device connected with, and providing an output signal to, a display device.

10. The flame detection circuit of claim 8, wherein an output of said second comparator is connected with a display device.

11. A flame detection circuit for a burner having a transistor coil ignition system that includes a trigger stage connected with a primary winding of an ignition coil for triggering a power transistor located in a power circuit of the primary winding of the ignition coil, comprising:

current control means connected to said trigger stage for restricting charging current flowing in the primary winding of the ignition coil to a current level below a charging current level needed to generate an ignition spark in an ignition phase, said current control means comprising:

a first comparator having a first input and a second input;

a ramp generator connected with said first input of said first comparator, said ramp generator providing a linearly rising output voltage to said first input of said first comparator; and a current sensor connected with the primary winding of the ignition coil and said second input of said first comparator, said current sensor operating to provide the current level in the primary winding of the ignition coil to said second input of said first comparator, and analysis means connected with the primary winding of the ignition coil, said analysis means comprising first means for receiving a first signal from the primary winding, said first signal being .produced when said charging current flowing in the primary winding of the ignition coil is interrupted, and a second means for generating a second signal indicating whether a flame exists in the burner.

12. The flame detection circuit of claim 11, further comprising output means connected with said analysis means for receiving combustion information from said analysis means and for processing and displaying said combustion information, said current sensor also being connected with said output means and operating to provide the current level in the primary winding of the ignition coil to said output means.

13. The flame detection circuit of claim 12, wherein said output means comprises a display device.

14. The flame detection circuit of claim 6, wherein said analysis means comprises:

a rectifier connected with the primary winding of the ignition coil;

integration means connected with said rectifier for integrating an output signal received from said rectifier; and a second comparator having a first input and a second input, wherein said first input of said second comparator is connected with said integration means, said second input of said second comparator is connected with a predetermined reference value, and said comparator produces a flame status signal indicating whether a flame exists in the burner that corresponds to a comparison of said signal received from said integration means and said reference value.

15. The flame detection circuit of claim 13, further comprising an ignition diagnosis device connected with said display means, wherein said ignition diagnosis device provides an output signal to said display means.

16. The flame detection circuit of claim 15, wherein an output of said second comparator is connected with said display means.

* * * * *